United States Patent [19]

Mendenhall

[11] Patent Number: 4,957,429

[45] Date of Patent: Sep. 18, 1990

[54] METHOD AND APPARATUS FOR REMOVING VOLATILE HYDROCARBONS FROM PARTICULATE SOILS

[76] Inventor: Robert L. Mendenhall, 1770 Industrial Rd., Las Vegas, Nev. 89102

[21] Appl. No.: 395,604

[22] Filed: Aug. 18, 1989

[51] Int. Cl.[5] ..... F23G 5/20; F27B 15/12

[52] U.S. Cl. ..... 432/14; 432/13; 432/105; 432/111; 110/236

[58] Field of Search ..... 432/105, 106, 111, 13, 432/14; 110/246, 236; 34/181, 182, 183

[56] References Cited

U.S. PATENT DOCUMENTS

| | | | |
|---|---|---|---|
| 1,187,959 | 6/1916 | Ash | 366/22 |
| 2,654,592 | 10/1953 | Harris . | |
| 3,693,945 | 9/1972 | Brock | 259/146 |
| 3,705,711 | 12/1972 | Seelandt et al. | 263/32 R |
| 3,866,888 | 2/1975 | Dydzyk | 259/158 |
| 4,104,736 | 8/1978 | Mendenhall | 366/2 |
| 4,153,471 | 5/1979 | Mendenhall | 106/281 |
| 4,211,490 | 7/1980 | Brock et al. | 366/11 |
| 4,298,287 | 11/1981 | McCarter, III et al. | 366/4 |
| 4,429,642 | 2/1984 | Deve | 110/236 |
| 4,555,182 | 11/1985 | Mendenhall | 366/25 |
| 4,648,332 | 3/1987 | Goedhart | 110/346 |
| 4,648,333 | 3/1987 | Mudd et al. | 110/346 |
| 4,667,609 | 5/1987 | Hardison et al. | 110/236 |
| 4,700,638 | 10/1987 | Przewalski | 110/346 |
| 4,748,921 | 6/1988 | Mendenhall | 110/346 |
| 4,787,938 | 11/1988 | Hawkins | 432/14 X |
| 4,827,854 | 5/1989 | Collette | 110/246 X |

FOREIGN PATENT DOCUMENTS

| | | | |
|---|---|---|---|
| 3216771 | 12/1982 | Fed. Rep. of Germany | 110/236 |

*Primary Examiner*—Henry A. Bennet
*Assistant Examiner*—C. Kilner
*Attorney, Agent, or Firm*—Jerry R. Seiler

[57] ABSTRACT

A continuous method of removing volatilizable organic composition from particulate mineral composition comprises heating the organic composition contaminated mineral particles in a rotating drum and exposing the particles to said hot gases to volatilize the organic composition from the mineral particles while advancing the particles counter-current to the direction of hot gas flow, removing a gaseous composition from the drum comprising a mixture of the gases of combustion, volatilized organic composition and airborne fine mineral particlles, separating the fine mineral particles from the hot gases and volatile volatilized organic composition, returning the separated fine mineral particles into the drum near the hot end, mixing the fine particles with the coarse mineral particles advancing toward the hot drum end, continuing to heat the mixture of fine and coarse mineral particles until the concentration of volatilizable organic composition is less than about 100 parts per million, and recovering a mixture of coarse and fine mineral particles adjacent said first drum end. The invention includes a preferred apparatus for carrying out the process.

19 Claims, 1 Drawing Sheet

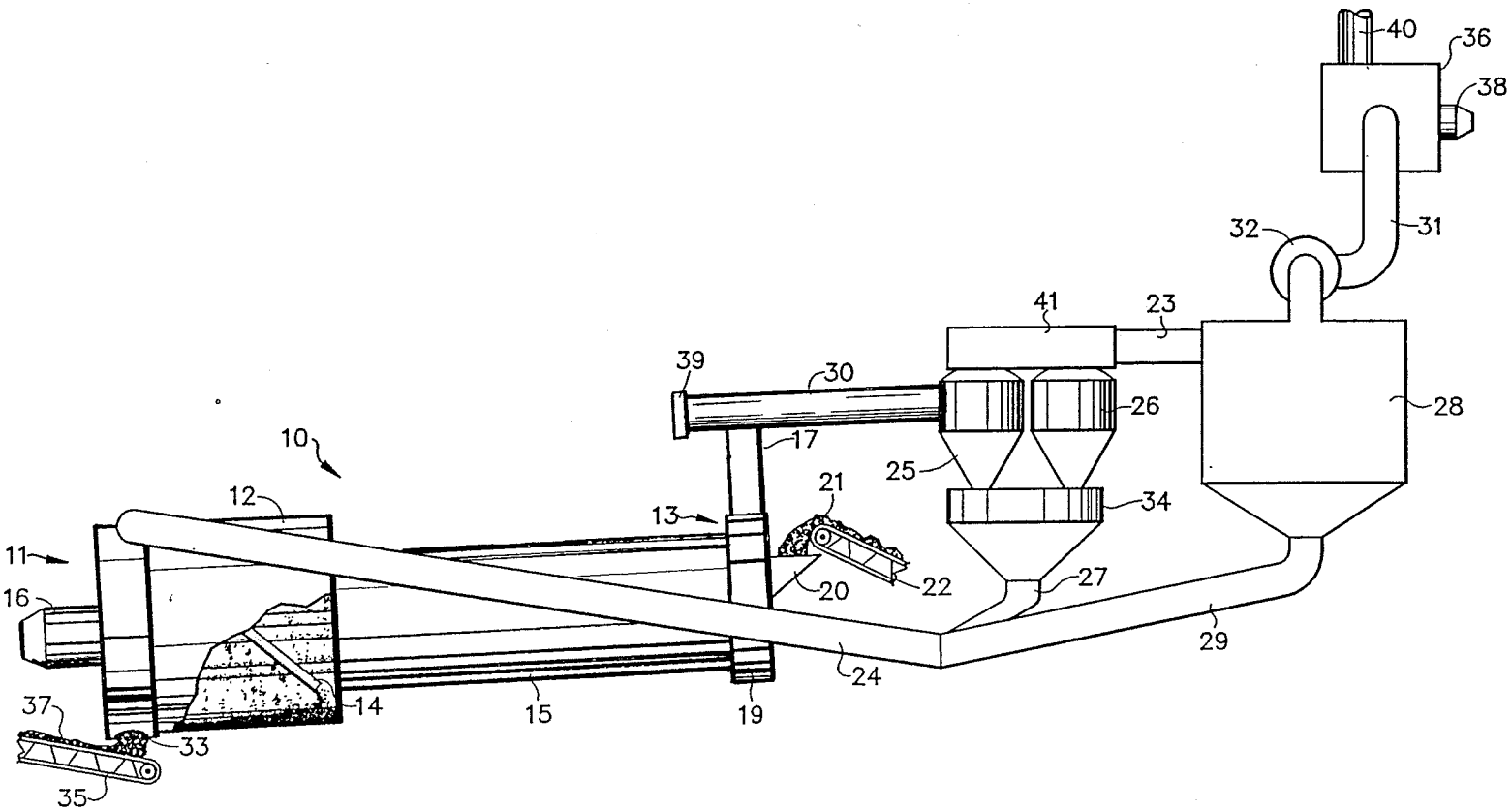
10
11
12
13
14
15
16
17
19
20
21
22
23
24
25
26
27
28
29
30
31
32
33
34
35
36
37
38
39
40
41

METHOD AND APPARATUS FOR REMOVING VOLATILE HYDROCARBONS FROM PARTICULATE SOILS

BACKGROUND OF THE INVENTION

The presence of hydrocarbons in soils has become more problematic in recent years. The hydrocarbons, often inadvertently spilled on the soil, particularly around service stations, airports, and refineries in industrial areas and urban centers, have leached and percolated through the soil to aquifers, reservoirs, lakes and other sources of potable water. In many areas, local, state and/or federal environmental regulations require that the contaminated soil be dug up and removed and stored indefinitely in hazardous waste sites, at substantial expense and inconvenience as well as burdening public contamination holding facilities.

In my prior patent no. 4,748,921, there are disclosed a method and apparatus for removing volatile or flammable hazardous liquid waste from soils utilizing a rotating drum. The contaminated particulate soil is exposed to flame and hot gases of combustion and the volatile hydrocarbons from the soil are burned in the drum during the process. Although that apparatus and method are suitable for treating smaller quantities of particulate soil, especially in smaller batch-type operations, it is not entirely suitable or efficient for substantially larger quantities of soil treatment.

SUMMARY OF THE INVENTION

The method of the present invention provides an efficient process for treating and removing substantial amounts of hydrocarbons from particulate mineral compositions. The method provides for reducing the volatilizable hydrocarbons to acceptable amounts of less than about 100 parts per million, and preferably lower, as required by environmental regulations. According to the process, fine particles which escape from the drum in the exhaust stream are separated and returned to the heating drum to be further heated and mixed with coarse particles, which have remained in the drum. Thus, substantially all of the particulate mineral material may be recovered in the final product composition. The volatilized hydrocarbons are burned in a separate furnace to achieve a final gaseous effluent which may be safely discharged to atmosphere without violating air pollution standards. In a preferred embodiment, a novel heating drum is provided to further improve the process.

BRIEF DESCRIPTION OF THE DRAWING

The drawing shows a preferred apparatus of the invention and illustrates the process.

DETAILED DESCRIPTION OF THE INVENTION

Although the process is particularly advantageous for removing hydrocarbons from soils, it is to be understood that other particulate mineral materials, such as sands, clays, dried drilling muds, pumice, etc. may be treated according to the invention to achieve substantially the same results. Thus, the scope of the term "soil" as sometimes used herein is intended to include any particulate mineral materials and compositions having a range of particle sizes which include a fine particle size fraction that will escape from the drum in an exhaust gas stream mixture. Moreover, the term "hydrocarbons" as used herein is intended to include not only compounds containing exclusively carbon and hydrogen but other organic compounds, for example, alcohols, phenols, ethers, acids, esters, aldehydes, ketones, waxes, fats, oils, amines, sulfides, phosphates, etc., which can be volatilized from the particulate compositions in the drum by heating, and which can be burned or oxidized in furnace or afterburner, or otherwise treated for removal from a gas stream that may be safely exhausted to atmosphere.

Referring to the drawing, the process is carried out by introducing the hydrocarbon-contaminated particulate soil 21 into heating apparatus 10 via a conveyor 22 or other convenient means for introducing the composition into the drum. Although the heating drum apparatus may be a conventional rotatable, cylindrical aggregate dryer well known to those skilled in art, a preferred drum is illustrated in the drawing and will be described hereinafter. The drum is tilted with respect to horizontal and the particulate composition is introduced at the elevated drum end 13 with burner 16 introducing flame and hot gases of combustion at the lower opposite end 11. The contaminated soil composition introduced via hopper 20 and which comprises both coarse and fine particles, is gradually heated as the soil particles are exposed to the hot gases of combustion as they are gravitationally drawn toward end 11 and recovered at port 33. Flights or trays, known in the art, are provided along the drum interior for alternately lifting and dropping the particulate soil causing it to cascade through the hot gases thereby becoming gradually heated to a temperature at which the hydrocarbons are volatilized and evaporate from the solid particulate mass.

At elevated drum end 13, exhaust pipe 17 communicates with drum end cover 19 for directing a gaseous mixture of hot gases, hydrocarbon volatiles and particulate soil fines from the drum. Although end cover 19 and exhaust pipe 17 are shown, other equivalent means for recovering and directing the mixture of gases and fine particles may be used. The exhaust system for treating the gas/fine particle mixture is driven by a blower or exhaust fan system creating a partial vacuum (pressure drop) at elevated end 13 of the drum relative to lower end 11. The management of this exhaust system to provide for the proper flow rate or draft of the gaseous/particulate mixture may be adjusted by increasing the exhaust blower size and/or speed, or, for example incorporating a bleed valve 39, or using other means. The desired temperature of the exhaust gas, the temperature of soil to be recovered, and the type of hydrocarbons or other volatilizable organic compounds present in the soil composition will also be considered in managing the drum temperature and the exhaust gas flow rate.

In treating the exhaust gas mixture from the drum, the hot gases and hydrocarbon volatiles, which may also include some gaseous products resulting from burning volatilized hydrocarbons in the drum, are first separated from the particulate fines. The fines are returned to the drum for further processing, and ultimately recovered with the larger coarse particles which remain in the drum during the process. The term "particulate fines" or "fine" particles as used herein is intended to include the mineral particles which become airborne and mixed with the gaseous stream withdrawn from the drum. Normally, the smallest of such fines are between about 1 and about 100 microns diameter, although the fines entrained into the gas stream may include particles up to about ⅛ inch diameter which pass into the gas treating portion of the apparatus. It is the treatment of such fines, regardless of specific size, that the present invention is particularly useful. Although the amount of fines present in the gas/particle stream withdrawn from the drum may be relatively small in relation to the total volume or weight of the soil mass being treated, for example, commonly between about 10% and 20% of the total recoverable mass of treated material, the amount of hydrocarbon present in such fines is proportionately large because of the surface to mass ratio. Thus, the treatment of this gas/fine particle mixture is particularly important to the invention.

The gaseous stream recovered via conduit or pipe 17 is directed initially into a primary separator. In the embodiment shown, dual cyclone separators 25 and 26 are used, by way of example only. A dry cyclone separator is a very efficient primary means for separating the majority of particulate mass from the remainder of the gaseous stream. Such a cyclone separator or collector may include multiple cyclone tubes in various arrangements and combinations, well known to those skilled in the art. In such a cyclone separator, the gas/particulate mixture is treated centrifugally with the solid particles settling at the bottom of the cyclones where they are discharged into a collector funnel 34, and withdrawn into collector pipe 27. The lower limit of the size of fines efficiently separated by the cyclone filter is generally between about 5 and about 10 microns. Thus, for example, while over 50% of the 10 micron particles will commonly be recovered by the cyclones, 20% or less of the 5 micron fines are removed.

The gas stream mixture, now comprising the hot gases, hydrocarbons and remaining smaller fine soil particulates, is then directed successively from the outlet of the cyclone assembly through a gas directing cover 41, conduit 23 and into the secondary separator 28. Such a secondary separator is conveniently of a baghouse design, well known to those skilled in the art, for further separating the relatively small mass of particulate fines from the gases. For purposes of the invention, it has been found, for example, that a pulsating or pulsing cycle baghouse design is quite suitable and effective, although such an apparatus is by way of example only. The baghouse separators will normally recover between about 75% and about 99% of the smaller fines, having an average diameter between about 1 and about 10 microns. In earthen soil particles, these small recoverable fines normally account for between about 1 ½ and about 3% of the total particulate mass. However because of the relatively large surface/mass ratio of these smaller fines, this particulate fraction contains a substantial amount of the hydrocarbons to be removed in the process. The dust particles settle to the bottom of the baghouse and are directed via collector pipe 29 or similar conduit where they are combined with the particles obtained from the primary separator system and are directed back to the drum apparatus. The separated gas components are pulled from the baghouse with exhaust fan 32 into furnace 36 via pipe 31. In the furnace, the hydrocarbons are oxidized and burned to achieve a gaseous mixture which is exhausted to atmosphere via exhaust pipe 40.

The primary and secondary separators will remove substantially all, or over 99%, of the particulates in the exhaust gas stream. The recovered solid particle fines are preferably returned to the drum using any suitable means. A dust screw conveyor 24 is illustrated, well known in the art for moving such small solid particles. The particulate fines recovered from the separators are introduced into the drum between the drum ends, where they become mixed with the coarse particles gradually advancing toward the lower drum end 11. The specific location between the drum ends is selected to prevent returning a large or significant volume of the fines to the gas separator system, which would occur if the particles are introduced too close to the elevated drum end 13. On the other hand, if the fines are introduced too near the lower drum end 11, they may not be heated substantially or completely enough to volatilize and remove the desired amount of hydrocarbons before discharge. A preferred location will be somewhere along the forward (lower) 50%, and more preferably the forward third of the overall drum length, but back away from the burner far enough to allow sufficient heating and hydrocarbon volatilization as the particles advance to drum end 11 and are recovered. It has been found that depositing the fines at a location of between about one-fifth and about one-third of the drum length distance from the burner end is quite suitable. Means for changing or varying the fines discharge location along the drum may also be used. A discharge chute or pipe 14, as illustrated in the drawing, and preferably adjustable for changing the discharge location, may be used, as may other equivalent means, such as an extendable/-retractable pipe or chute. By changing the discharge location, an operator may vary and control the dwell time and temperature of the fines exposed in the drum.

In a preferred embodiment of the invention, a drum is used having two different successive sections, a first forward section having a larger diameter than the second rearward section and with the smaller diameter section of the drum longer than the larger diameter section. Such a drum is illustrated in FIG. 1, with a smaller diameter and longer second section 15 extending from the elevated end 13 of the drum toward lower end 11, and first drum section 12 being of shorter length and larger diameter extending from the end of section 15 successively along the same axis to the lower end 11 of the drum. Thus, in the single drum 10, the two drum sections are arranged end to end, and in open relationship, so that composition advances continuously from the elevated input end 13 to lower, output end 11. The advantage of such a drum is that in forward drum section 12, the gas stream velocity or draft is less than in the smaller diameter section 15 resulting in a longer dwell or heating period for the soil particles in the hotter portion of the drum and the lower gas velocity avoiding drawing the larger fines into the hot gas stream. In the second section of the drum, the smaller diameter yields an increased exhaust gas velocity, and the longer length provides for additional heating of the particles due to the increased time the particles are exposed to the hot gas stream. An example of suitable relative drum sizes are illustrated in the drawing where the second drum section is approximately three times the length and ¾ the diameter of the first drum section. However, other relative dimensions may also be selected to meet different volume and process parameters. A preferred drum has ratio of first section diameter:-second section diameter of between about 1.2:1 and about 2:1, respectively, and a first section length second section length of between about 1:2 and about 1:5 respectively. In the drum shown, the fines from screw conveyor 24 are discharged into the forward drum section 12 via pipe 14. Such a pipe, which slopes downwardly from the point of conveyor discharge, gravitationally directs the fines to the desired discharge location in the drum. As shown, pipe 14 discharges the fines near the back end of forward drum section 12. The discharge pipe, or other means may also be adjustable or movable so that the discharge location along the length of the first drum section may be changed to accommodate different heating or dwell times of the fines, if desired. Alternatively, other means for discharging the fines into the drum may be used, for example, a scoop and trough arrangement as disclosed, for example, in my U.S. Pat. No. 4,555,182, incorporated herein by reference.

The flights within the two different drum portions may be selected to achieve optimized, preferred exposure times of the particles within the respective drum portions to recover the soil composition introduced into the system in which substantially all of the hydrocarbons have been removed. Removal of "substantially all" of the hydrocarbons, as used herein, is intended to mean recovered soil having less than about 100 parts per million hydrocarbon. Preferably less than about 50 parts per million and more preferably less than about 25 parts per million hydrocarbon remains in the recovered soil. If desired, substantially all, or over 99.5% to practically 100%, of the soil material introduced into the system may be recovered, also an important feature of the invention. The fines removed from the particle separators and returned to the heating drum are ultimately recovered in the product mixture with the coarse particles. Moreover, because substantially all of the soil may be recovered in the process the need for "make-up" soil is minimized or eliminated.

Although recovery of substantially all of the particulate mass is preferred, there may be process conditions including the treatment of certain particulate materials in which removal of small fines from the process may be desired. For example, where the amount of hydrocarbon initially present in the soil is particularly great, and/or the hydrocarbon includes fractions or components which are difficult to remove, for example, having relatively high temperature boiling points, it may be desirable to pull out of the process all or a portion of the baghouse fines. These fines may then be handled and stored as hazardous materials in suitable repository, or otherwise disposed or discarded. Moreover, where such fines to be disposed outside of the process can be identified by particle sizes, it may also be useful to separate fractions of particles recovered from the cyclone separators, and return a portion of the particles to the drum, while disposing or discarding other portions. In this manner, the process can be modified and tailored to selectively pull out certain particulate fine fractions while returning other fractions recovered to the drum for further heating, as described.

The final or ultimate temperature to which the soil particles are heated and recovered will depend primarily on the nature of the hydrocarbons to be removed. Where the hydrocarbons are quite volatile such as gasoline, heating the soil to between about 300° F. and about 600° F. will usually suffice. If only gasoline is present, the hydrocarbons in the mixture have boiling points ranging from about 140°-390° F. However, if heavier, higher boiling hydrocarbons are present, the burner output and filter equipment high temperature limitations will dictate the practical heating extremes. Insulation of the drum, conduits and ducts provides for increased product temperatures and improves heating efficiency. Thus, product temperatures of up to 1500° F. may be achieved, if desired or required. Yet, regardless of the specific hydrocarbons or hydrocarbon mixtures present in the soil, according to the invention, the soil may be heated to the temperature and extent necessary to remove substantially all volatilizable hydrocarbons. The type and quantity of hydrocarbon (organic compound) present in the particulate composition to be treated may be identified by analysis and the burner output adjusted, if necessary, to achieve the desired heating temperature. The apparatus of the invention may include means for selectively monitoring and analyzing the hydrocarbons present in the particulate composition 21 fed to the heating drum and adjusting the output of burner 16 to achieve the desired and necessary heating. Such analysis and adjustment of the burner may be accomplished automatically using control means including microprocessor or computer means, not shown.

The final treatment of gaseous effluent to be discharged to atmosphere is an important feature. Of course, if the hydrocarbon soil contaminants are relatively light, for example, where gasoline or the like is the only contaminant, and the location of effluent discharge is in an area where such light hydrocarbon emissions are permitted, afterburner requirements may be minimal, or at least diminished. However, in other locations where hydrocarbon discharge is not allowed, or strict emission standards are to be met, afterburner requirements will be most important. Burner specifications, effluent dwell times, volumes, furnace and effluent temperatures and the like may be selected and tailored to meet specific requirements as will be understood and appreciated by those skilled in the art. Where the chemicals which have been removed from the soil comprise compounds or mixtures which cannot be safely burned or oxidized and exhausted directly to atmosphere, the gases from afterburner 36 may be directed to suitable treatment equipment via exhaust stack 40. Other embodiments and modifications within the purview of the invention will be evident to those skilled in the art.

I claim:

1. A continuous method of removing a volatilizable organic composition from a particulate mineral composition containing said organic composition comprising:

introducing hot gases of combustion into a first end of a rotatable drum and directing said hot gases toward a second of said drum end, introducing said particulate mineral composition comprising a mixture of coarse and fine particles into said drum adjacent said second end and rotating said drum and exposing said particles to said hot gases while advancing said particles toward said first end, removing a gaseous composition from said drum comprising a mixture of said gases of combustion, volatilized organic composition, and fine particles of said mineral composition at said second end, separating the fine particles of said mineral composition from said gaseous composition, directing fine particles separated from said gaseous composition into said drum at a location along a drum length between said first and second second ends, mixing the fine particles with coarse particles advancing toward said first end, and continuing to heat the mixed fine and coarse particles until the concentration of volatilizable organic composition therein is less than about 100 parts per million, and recovering a mixture of coarse and fine mineral composition particles adjacent said first end, 2. Process of claim 1 wherein the coarse and fine particles are heated in said drum to volatilize substantially all of said volatilizable organic composition.

3. Process of claim 1 including directing the gaseous composition containing the hot gases of combustion and volatilized organic composition separated from the fine mineral particles to a burner, and burning the volatilized organic composition.

4. Process of claim 1 wherein fine mineral particles separated from said gaseous composition are introduced into said drum at a location between the first end and about one-half of the drum length.

5. Process of claim 4 wherein a portion of the fine mineral particulates separated from said gaseous composition are discarded.

6. Process of claim 1 wherein fine mineral particles separated from said gaseous composition are introduced into said drum at a location between the first end and about one-third of the drum length.

7. Process of claim 1 including creating a first gas velocity of said hot gases from said first end to said second end along a first portion of said drum adjacent said first end, creating a second gas velocity of said hot gases along a second portion of said drum adjacent said second end, said second gas velocity being greater than said first gas velocity, and directing particulate mineral composition successively along said second and said first portions of said drum, respectively.

8. Process of claim 7 wherein fine particles separated from said gaseous composition are introduced into said first portion of said drum.

9. Process of claim 7 wherein fine particles separated from said gaseous composition are introduced into said first portion of said drum adjacent said second portion.

10. A continuous process for treating a particulate mineral composition contaminated with volatilizable organic composition comprising:

introducing hot gases of combustion into a first end of a rotatable drum and directing the hot gases toward a second end of said drum;

introducing said mineral composition comprising a mixture of coarse and fine particles into said drum adjacent said second end while rotating said drum and exposing said particles to said hot gases while advancing said mixture of particles toward said first end, removing a gaseous composition from said drum comprising a mixture of the gases of combustion, volatilized organic composition and fine particles of said mineral composition adjacent said second end, separating fine particles from the hot gases and volatilized organic composition in said gaseous composition, directing fine particles separated from said gaseous composition into said drum at location along a drum length between said first and said second ends, mixing the fine particles with coarse particles advancing toward said first end, and continuing to heat the coarse and fine particles in said drum until substantially all of the volatilizable organic composition is removed therefrom, directing the gaseous composition separated from said fine particles to a combustion chamber and burning the organic composition therein, and recovering a mixture of coarse and fine mineral composition particles adjacent said first end.

11. The process of claim 10 wherein the coarse and fine mineral composition particles are heated in said drum until the concentration of volatilizable organic composition in the mineral composition recovered from said drum is less than about 100 parts per million.

12. In a process for treating particulate mineral composition comprising coarse and fine particles portions containing volatilizable organic contaminants by introducing said mineral composition into a first end of a rotatable drum and heating said mineral composition with hot gases of combustion in said drum resulting in volatilization of said organic contaminants, separating the volatilized organic contaminants from the particulate mineral composition, and recovering mineral particulates at a second end of said drum, the improvement comprising:

removing a gaseous composition from said drum comprising a mixture of said gases of combustion, volatilized organic contaminants and fine particles of said particulate mineral composition adjacent said second end, separating the fine particles of said mineral composition from said gaseous composition, directing fine particles separated from said gaseous composition into said drum at a location along a drum length between said first and said second ends, mixing the fine particles with coarse particles advancing toward said first end, continuing to heat the mixed fine and coarse particles until the concentration of volatilizable organic composition therein is less than about 100 parts per million, and recovering a mixture of coarse and fine mineral composition particles adjacent said first end.

13. The process of claim 12 including directing the gaseous composition separated from said fine particles to a combustion chamber and burning the volatilized organic contaminants therein.

14. In a continuous process for treating particulate mineral composition comprising coarse and fine particles portions containing volatilizable organic contaminants by introducing said mineral composition into a rotatable drum and heating said mineral composition in said drum resulting in volatilization of said organic contaminants, separating the volatilized organic contaminants from mineral particulates, and recovering the mineral particulates, the improvement comprising:

removing a mixture of gases containing volatilized organic contaminants and airborne fine mineral particles from the drum, separating the gases from the fine mineral particles, returning the separated fine mineral particles to the drum, and continuing to mix and heat the fine mineral particles returned to the drum with the particulate mineral composition therein until the concentration of volatilizable organic contaminants in the recovered particulate mineral product is less than about 100 parts per million.

15. The process of claim 14 including directing the gases separated from said fine mineral particles to a combustion chamber and burning the volatilizable organic contaminants therein.

16. The process of claim 14 wherein hot gases of combustion are introduced into a first end of said drum toward a second end, and wherein fine mineral particles separated from said gaseous composition and returned to said drum are introduced into said drum at a location between said first end and about one-half of the drum length.

17. The process of claim 16 including creating a first gas velocity of said hot gases from said first end to said second end along a first portion of said drum adjacent said first end, creating a second gas velocity of said hot gases along a second portion of said drum adjacent said second end, said second gas velocity being greater than said first gas velocity, and directing particulate mineral composition successively along said second and said first portions of said drum, respectively.

18. The process of claim 17 wherein fine mineral particles separated from said gases are introduced into said first portion of said drum.

19. The process of claim 18 wherein fine mineral particles separated from said gases are introduced into said first portion of said drum adjacent said second portion of said drum.

* * * * *